United States Patent [19]

Dubey

[11] 4,371,073

[45] Feb. 1, 1983

[54] COIN CHECKER FOR COINS OF VARYING DIAMETER

[75] Inventor: Pierre Dubey, Zollikofen, Switzerland

[73] Assignee: Autelca AG, Switzerland

[21] Appl. No.: 175,579

[22] Filed: Aug. 5, 1980

[30] Foreign Application Priority Data

Aug. 8, 1979 [CH] Switzerland ..... 7300/79

[51] Int. Cl.[3] ..... G07D 5/02

[52] U.S. Cl. ..... 194/102; 194/100 A; 73/163

[58] Field of Search ..... 194/97 R, 97 A, 100 R, 194/100 A, 102; 73/163; 336/134

[56] References Cited

U.S. PATENT DOCUMENTS

| | | | |
|---|---|---|---|
| 3,209,294 | 9/1965 | Cornell | 336/134 |
| 3,373,856 | 3/1968 | Kusters et al. | 194/100 R |
| 3,738,469 | 6/1973 | Prümm | 194/101 |
| 3,796,295 | 3/1974 | Montolivo et al. | 194/100 A |
| 3,952,851 | 4/1976 | Fougere et al. | 194/100 A |
| 4,091,908 | 5/1978 | Hayashi et al. | 194/100 A |
| 4,184,366 | 1/1980 | Butler | 194/100 A X |

*Primary Examiner*—Robert B. Reeves
*Assistant Examiner*—Edward M. Wacyra
*Attorney, Agent, or Firm*—Brady, O'Boyle & Gates

[57] ABSTRACT

The coins (8) are thrown into a common coin channel and affect the field of a coil (2; 52). The coil core consists either of several U- or E-cores (54, 55) arranged at right angles to the coin travel direction (5) in direct or spaced-apart adjacency, or of an oblong core (3) U- or E-shaped in cross section which lies at right angles to the coin travel direction. The spacing of the two outermost cores (54, 55) and/or the length of the core (3) is dimensioned to be of such a size that the coins (8) of varying diameter affect the coil field differently. The circuit for determining the effect on the field can comprise, for example, an alternator supplying the coil (2; 52) and a further coil (7; 53) coupled to the coil and connected to a comparison circuit. By means of the coil checker according to the invention it is possible to reliably test and determine even coins having greatly varying diameters.

13 Claims, 5 Drawing Figures

COIN CHECKER FOR COINS OF VARYING DIAMETER

The invention relates to two coin checkers for coins of varying diameter with a coil, through the field of which extends the coin slot channel common to all coins, and with a circuit evaluating the effect on the coil field.

In the conventional coin checkers, the coins to be tested enter, for example, the coil field of the oscillatory circuit of an oscillator whereupon the oscillations of the latter either cease or do not cease, depending on the electrical (and magnetic) properties of the coin alloy (or the coin metal). If the evaluating circuit detects the cessation of the oscillations, it triggers, for example, the acceptance of the coin, otherwise the return of the coin.

It is possible to reliably determine, with the aid of the conventional coin checkers, whether an inserted coin and/or some other metallic body has the same alloy as the coin of the acceptable kind. However, it has been impossible heretofore to find a satisfactory solution for determining the diameter of differently large coins dropped into the same coin slot. However, especially the coin diameter is particularly significant for the value of the inserted coins.

The invention starts with the realization that the cup [pot] cores heretofore utilized for the coils of the coin checkers produce a coil field unsuitable for determining the diameter. If it is intended to use a cup core for testing the diameter, a large core must be utilized, the diameter of which is adapted, for example, to the largest acceptable coin type. The cup core in this case not only occupies a large amount of space but also has, above all, the disadvantage that very small coins affect its coil field practically not at all, but in any event only in a way which is difficult to measure. Even if the field were distributed homogeneously over the entire cup, the effect on the field would still decrease with the square of the diameter of the coins. However, actually, the field is not homogeneously distributed but rather is concentrated in the central zone of the cup core. Small coins, however, pass only the marginal zone of the cup core where the field is weak or—in the annual space between the outer shell of the cup and the central projection—is entirely nonexistent.

It is an object of the invention to provide a coin checker, by means of which even coin diameters which greatly deviate one from the other can be reliably determined.

The attainment of this object according to the invention is set out in claims 1 and 7. Preferred embodiments are described in claims 2–6 and 8–10.

Figure 1:
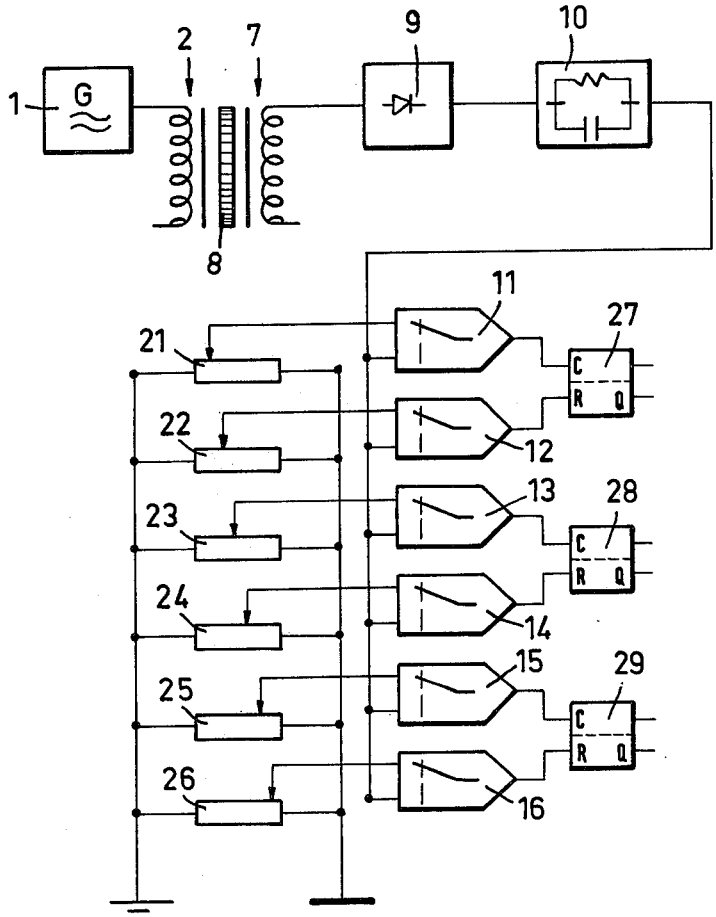
Figure 2:
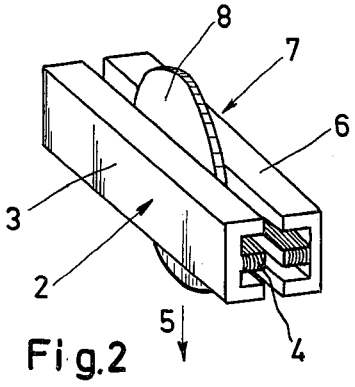
Figure 5:
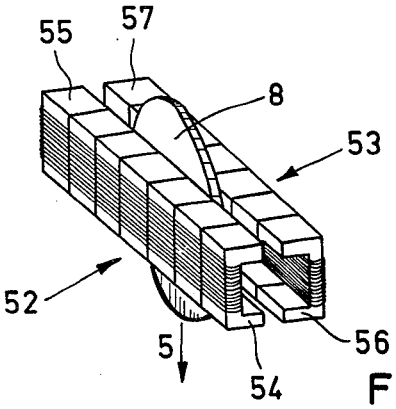
Figure 4:
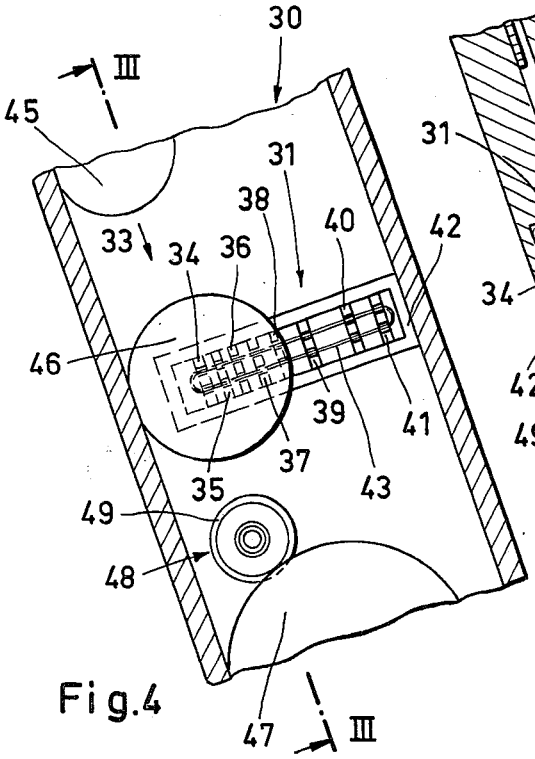
Figure 3:
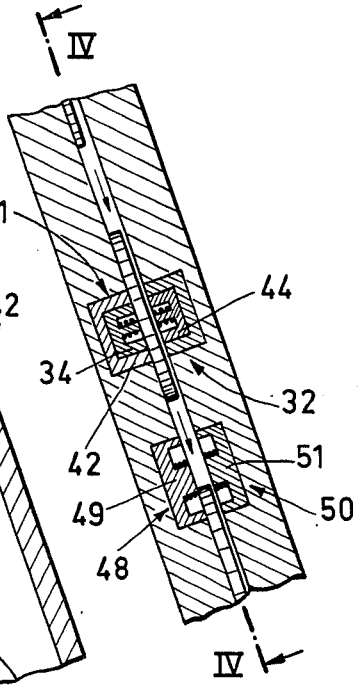

Embodiments of the invention will be described in greater detail below with reference to the appended drawings wherein:

FIG. 1 is the block circuit diagram of a coin checker circuit portion with two coupled coils, FIG. 2 is a perspective view of an embodiment of the coupled coils of the circuit portion according to FIG. 1, FIG. 3 is a section along part of the coin slot channel of a coin checker equipped with another embodiment of the coupled coils (along line III—III of FIG. 4), FIG. 4 is a section along line IV—IV of FIG. 3, and FIG. 5 is a modification of the coils shown in FIG. 2.

In the coin checker according to FIGS. 1 and 2, the coins of varying diameter to be tested are dropped into a common coin slot channel (not shown) which leads through the field of a coil 2 arranged along one of its lateral sides and connected to the output of an alternator 1. The AC frequency of the generator 1 is 100 kHz. The coil 2—as shown in FIG. 2—has an oblong core 3 of an E-shape in cross section; the coil winding is wound onto the central leg 4 of the core 3. The core 3 dimensioned approximately as long as the diameter of the largest acceptable type of coin is disposed at right angles to the coin travel direction indicated by an arrow 5; its dimension in this direction is merely one-fifth of its length.

On the lateral side of the coin channel in opposition to the coil 2, a coil 7 is arranged which is constructed exactly alike, i.e. also with an oblong core 6 of an E-shaped cross section. The legs of the core 6 lie in the three identical planes extending at right angles to the coin travel direction 5 as the legs of the core 3, so that a maximally satisfactory inductive coupling of the coils is attained. The coupling is affected by the coins dropping through the coin channel extending between the coils 2, 7.

In the drawing, a coin 8 of medium size is shown while passing past the coils 2, 7.

The coil 7 is connected to the input of a rectifier 9 the output of which is connected to a smoothing member 10. The output of the smoothing member is connected with one of the inputs of six comparators 11–16, the other inputs of which are each connected, via respectively one potentiometer 21–26, to a voltage source. The outputs of the comparators 11–16 are connected in pairs to bistable multivibrator members 27–29, namely the comparators 11, 13, and 15 to the C-inputs and the comparators 12, 14, and 16 to the R-inputs of the multivibrator members. A control section (not shown), which controls the coin cashing device, is connected to the Q-outputs of the multivibrator members 27–29 and to a sweep signal generator (not shown) arranged in the coin travel direction 5 after the coils 2, 7.

The coin checker circuit portion shown in FIG. 1 is designed for the checking and determination of three types of coins with varying diameters. Once a coin 8 to be checked has entered the field of the coil 2, the inductive coupling between the coils 2 and 7 is reduced and thus the generator signal fed to the rectifier 9 is weakened. The smoothed DC signal at the output of the smoothing member 10 thus becomes smaller when a coin is passing through. This signal attains a minimum if the coin 8 exerts maximum influence on the coil field—as shown in FIG. 2—i.e. if the center of the coin lies between the central legs of the cores 3, 6, and the coin affects with its entire diameter the field between the central legs. Thereafter the signal strengthens again and regains its original value after the coin has passed through.

The signal minimum is, of course, the smaller, the larger the coin, namely it is rather exactly indirectly proportional to the coin diameter, because, after all, this diameter is governing for affecting the essential field portion between the central legs of the cores 3, 6.

The comparators 11–16 compare the output signal of the smoothing member 10 with the voltage delivered by the respective potentiometer 21–26. The potentiometers 21–26 determine, for each of the three acceptable types of coin, a permissible voltage range for the minimum output signal of the smoothing member 10. The potentiometer 21 yields a voltage, for example, which is higher by one tolerance than the minimum output voltage of the smoothing member 10 while the smallest acceptable type of coin passes through; the potentiometer 22 yields a voltage which is lower by one tolerance. Correspondingly, the potentiometers 23, 24 and 25, 26 deliver voltages higher or lower by one tolerance, respectively, than the output voltage of the smoothing member 10 at the medium and at the largest type of coin. The comparators 11 through 16 yield a signal (value 1) if the output voltage of the smoothing member 10 is smaller than the output voltage of the respective potentiometer 21–26.

In case of an acceptable coin of the smallest type, the output voltage of the smoothing member 10 drops below the voltage value delivered by the potentiometer 21, and the comparator 11 sets the multivibrator member 27, i.e. it enforces the setting of the value 1 at the associated Q-output. The sweep signal generator (not shown) activates the control section (not shown) upon passage of the coin; this control section triggers, on the basis of the value 1, the acceptance of the coin at the Q-output of the member 27 and transmits the smallest coin value associated with this coin to the arithmetic unit of the coin cashing device. Thereupon the control section actuates a resetting device (not shown) which resets all of the multivibrator members 27–29 into zero condition. With an acceptable coin of the medium-sized coin type, the output voltage of the smoothing member 10 drops to a value lying between the voltage values of the potentiometers 23 and 24. During this step, the comparators 11, 12, and 13 yield, in succession, signals to the multivibrator members 27 and 28. The multivibrator member 27 is set into condition 1 by the comparator 11, and reset into condition 0 by the comparator 12, whereupon the comparator 13 sets the multivibrator member 28 into condition 1. The member 28 remains in this condition, because the minimum of the output voltage supplied by the smoothing member 10 lies above the voltage value transmitted by the potentiometer 24, i.e. the comparator 14 does not reset the multivibrator member 28. During the subsequent read-out [interrogation], the control section determines the condition 1 of the member 28, and the resetting device reestablishes the resetting condition at the member 28. In case of an acceptable coin of the largest type of coin, the multivibrators 27 and 28 are correspondingly set initially in succession into condition 1 and thereupon reset into condition 0. The multivibrator member 29 is then set into condition 1, interrogated by the control section, and reset again.

In case of an unacceptable coin with a diameter deviating from that of the acceptable coins, the output voltage of the smoothing member 10 drops to a value lying in the range which is not permissible, i.e., for example, between the voltages supplied by the potentiometers 22 and 23. During the drop in voltage, the initially set multivibrator member 27 is reset, while the multivibrator member 28 is not set. None of the multivibrator members is, therefore, in condition 1 during the interrogation of the control section, which indicates the unacceptableness of the coin.

It has been presupposed in the above embodiment that the coins are of a nonmagnetic material. In case of coins of a magnetic material, the coupling of the coils 2 and 7 would increase with the diameter of the coins. The circuit structure for the examination of magnetic coins, however, could be basically the same as described hereinabove.

Furthermore, it has been assumed that the coupling is dependent merely on the coin diameter, rather than on the coin alloy, or is dependent on the latter only to a negligible extent. At the AC frequency of 100 kHz supplied by the generator 1, this is indeed ensured practically for all alloys.

A testing of the coin diameter entirely independently of the alloy properties is suitable especially if an alloy examination step is additionally conducted by means of a separate testing coil (see the coils 48, 50 in FIGS. 3 and 4 described below). Otherwise, it is, of course, also possible to choose a lower AC frequency, at which diameter and alloy affect the coupling. (It is, of course, a prerequisite that the alloy differences do not exactly compensate for the change in coupling caused by the varying coin diameters.) For the sake of completeness, it is to be noted that the coupling, of course, also depends on the thickness of the coins, so that coins of a larger diameter affect the coil field, due to their normally greater thickness, even somewhat more than would be expected on the basis of solely their diameter.

The coin checker according to FIGS. 3 and 4 differs from that described above by the shape of the core of the coupling coils pertaining to a circuit constructed according to FIG. 1. Two coupling coils 31, 32 are disposed in mutual opposition at the coin slot 30 of the coin checker—as in the above-described embodiment. The core of coil 31 consists of eight E-cores 34–41 arranged at varying mutual spacings in a holder 42 which is located at right angles to the coin travel direction 33 and is U-shaped in cross section, so that the legs of these E-cores are disposed perpendicularly to the coin travel direction 33. The dimension of the E-cores 34–41 in the coin travel direction 33 is one-fourth the distance of the mutually facing-away surfaces of the two outermost cores 34 and 41. The coil winding 43 surrounds the central legs of the E-cores 34–41. The coil 32 correspondingly has also eight E-cores 44 disposed in exactly symmetrical opposition to the cores 34–41 at the coin slot 30.

Respectively one coin 45, 46, 47 of the three differently large types of coin to be checked is illustrated in the coin slot channel 30. The arrangement of the cores 34–41 and of the holder 42 is selected so that, on the one hand, unacceptable coins, the diameters of which deviate only to a minor extent from those of the acceptable types of coin, affect the coil field maximally differently from the acceptable coins and that, on the other hand, the effect on the coil field is approximately proportional to the diameter of the acceptable coins. The first condition is met in that the three coins 45, 46, 47 rolling along the narrow wall of the coin channel 30, shown on the left-hand side in FIG. 4, cover in each case precisely one core while passing the coil 31 on the right-hand side, namely the core 36, 38, or 40, but do not affect the field of the core 37, 39, or 41 lying immediately to the right thereof. An unacceptable coin with a diameter that deviates only to a small extent either no longer covers the core 36, 38, or 40, or additionally covers the core 37, 39, 41, which leads to a change in coupling and thus in the output signal of the smoothing member which is larger than the tolerance adjusted at the potentiometers for the acceptable coins. While passing the coil 31, the coin 45 covers the three cores 34–36; the coin 46 covers the five cores 34–38; and the coin 47 covers the seven cores 34–40. Due to the fact that the diameters of the three coins have a relationship which is approximately the same as the number of the cores respectively covered by the coins, the second condition is likewise met.

The coin checker furthermore comprises an alloy testing circuit (not illustrated in detail) with two coupling coils 48, 50 arranged at a spacing from the coils 31, 32 and comprising identical cup cores 49, 51. The outer diameter of the cup core 49 or 51 is smaller than the diameter of the smallest acceptable coin, whereby an alloy testing step is made possible which is independent of the coin diameter. (The circuit can have a similar structure as that in FIG. 1, wherein the AC frequency of the generator 1 is to be chosen smaller, namely so that the effect of the alloy on the coil field becomes maximal.)

In the version shown in FIG. 5 for two coupled coils 52, 53 for diameter checking, each of the two coil cores consists of seven U-cores cemented to each other, of which the outermost cores are denoted in the drawing by 54, 55 and 56, 57. The coil windings encompass the crossbars of the series-connected U-cores. The two coils 52,53 are arranged in mutual opposition at the coin channel, just as the coils 2 and 7, wherein the legs of the U-cores 54–57 lie in two planes extending perpendicularly to the coin travel direction. The U-cores 54, 55 and 56, 57 could be arranged in a holder similarly to the E-cores 34–41.

In the above-described examples, two coupled coils are provided in all cases, in correspondence with the circuit principle selected for FIG. 1, these coils mutually opposing each other at the coin channel. However, it is, of course, also possible to provide merely one coil pertaining as a self-inductive coil to an oscillatory circuit fed by a source of alternating current. The attenuation (or in case of magnetic coins, the amplification) of the oscillations occurring while a coin passes through the field of the self-inductive coil would then be a measure for the coin diameter (or for the alloy in case of coil 48).

The terms and expressions which have been employed herein are used as terms of description and not of limitation, and there is no intention, in the use of such terms and expressions, of excluding any equivalents of the features shown and described or portions thereof but it is recognized that various modifications are possible within the scope of the invention claimed.

I claim:

1. A coin checker for coins of varying diameters having a coin slot channel common to all coins, said channel having two narrow and two broad sides, a coil having a core, the coil field extending through said coin slot channel to be influenced by the coins (8; 45–47) passing through the channel on dependence on the diameter of the coins, and a circuit connected to evaluate the influence of the coins on the coil field and providing an output signal indicating that a coin of a predetermined diameter has travelled through said coil field, if the coin causes a variation in the coil field that lies within one of a plurality of predetermined ranges being representative for acceptable coins of different diameter, the improvement characterized in that said core consists of a plurality of shaped core parts (34–41, 54, 55) put in a row, each of said shaped core parts having at least two legs, said row of shaped core parts extending transversely to the coin travel direction from one narrow side to the other narrow side of said coin slot channel, the spacing of the mutually facing-away surfaces of the two outermost shaped core parts (34, 41; 54, 55) corresponding approximately to the diameter of the largest acceptable type of coin in said coin slot channel and the dimension of said shaped core parts in the coin travel direction (5; 33) being a fraction of the spacing of the mutually facing-away surfaces of the two outermost shaped core parts (34,41; 54,55).

2. A coin checker according to claim 1, in which the legs of the shaped cores (54, 55 and 34–41) extend perpendicularly to the coin travel direction (5; 33) of said coin slot channel.

3. A coin checker according to claim 1, in which said coil (52; 31) is one of two coupling coils (52,53; 31,32) located in mutual opposition on the opposite broad sides of said coin slot channel, each of said coils having a core, the cores (54–57; 34–41, 44) of the two coupling coils (52,53; 31,32) being of identical construction and being arranged symmetrically with respect to said coin slot channel.

4. A coin checker according to claim 1, including a second coil (48) connected to produce a second field in said coin slot channel and having a core (49), the dimension of the core of said second coil in both the coin travel direction and transverse to the coin travel direction being smaller than the diameter of the smallest acceptable coin (45), and second circuit means connected to evaluate the influence of the coins on the second coil field to provide an alloy testing step independently of the coin diameter.

5. A coin checker according to claim 1, in which said plurality of shaped core parts are U-shaped core parts.

6. A coin checker according to claim 5, in which said coil includes a winding (43) surrounding the crossbars of the U-shaped core parts (54,55).

7. A coin checker according to claim 1, in which said plurality of shaped core parts are E-shaped core parts.

8. A coin checker according to claim 7, in which said coil includes a winding (43) surrounding the central legs of the E-shaped core parts (34–41).

9. A coin checker for coins of varying diameters having a coin slot channel common to all coins, said channel having two narrow and two broad sides, a coil having a core, the coil field extending through said coin slot channel to be influenced by the coins passing through the channel on dependence on the diameter of the coins, and a circuit connected to evaluate the influence of the coins on the coil field and providing an output signal indicating that a coin of a predetermined diameter has travelled through said coil field, if the coin causes a variation in the coil field that lies within one of a plurality of predetermined ranges being representative for acceptable coins of different diameter, the improvement characterized in that said core (3) is E-shaped in cross section and has a cross-sectional dimension that comprises a fraction of its length and which extends transversely to the coin travel direction (5) from one narrow side to the other narrow side of said coin slot channel and the length of said core (3) corresponds at least approximately to the diameter of the largest acceptable type of coin in said coin slot channel.

10. A coin checker according to claim 9, in which the coil includes a winding that surrounds the central leg (4) of the E-shaped cross section core (3,6).

11. A coin checker for coins of varying diameters having a coin slot channel common to all coins, said channel having two narrow and two broad sides, a coil having a core, the coil field extending through said coin slot channel to be influenced by the coins passing through the channel on dependence on the diameter of the coins, and a circuit connected to evaluate the influence of the coins on the coil field and providing an output signal indicating that a coin of a predetermined diameter has travelled through said coil field, if the coin causes a variation in the coil field that lies within one of a plurality of predetermined ranges being representative for acceptable coins of different diameter, the improvement characterized in that said core (3) is U-shaped in cross section and has a cross-sectional dimension that comprises a fraction of its length and which extends transversely to the coin travel direction (5) from one narrow side to the other narrow side of said coin slot channel and the length of said core (3) corresponds at least approximately to the diameter of the largest acceptable type of coin in said coin slot channel.

12. A coin checker according to claim 11, in which the coil includes a winding that surrounds the crossbar of the U-shaped cross section core.

13. A coin checker according to claim 9 or 11, wherein the coil (2) is one of two coupling coils (2,7) lying in mutual opposition at the opposite broad sides of the coin slot channel, the cores (3, 6) of the two coupling coils (2,7) having the same oblong shape and the same cross section, and being arranged symmetrically to the coin slot channel.

* * * * *